US006968963B1

(12) United States Patent
Zakula, Sr. et al.

(10) Patent No.: US 6,968,963 B1
(45) Date of Patent: Nov. 29, 2005

(54) GRAPPLER CONTROL SYSTEM FOR A GANTRY CRANE

(75) Inventors: Daniel Brian Zakula, Sr., Mokena, IL (US); Daniel J. Olson, Orland Park, IL (US)

(73) Assignee: Mi-Jack Products, Inc., Hazel Crest, IL (US)

( * ) Notice: Subject to any disclaimer, the term of this patent is extended or adjusted under 35 U.S.C. 154(b) by 106 days.

(21) Appl. No.: 10/191,220

(22) Filed: Jul. 9, 2002

(51) Int. Cl.[7] ..... B66C 13/04
(52) U.S. Cl. ..... 212/270; 212/272; 212/276; 294/907
(58) Field of Search ..... 212/270, 272, 212/276; 294/907

(56) References Cited

U.S. PATENT DOCUMENTS

| | | | | |
|---|---|---|---|---|
| 2,718,320 | A | 9/1955 | Nelson et al. | |
| 3,504,556 | A * | 4/1970 | Mills | 74/96 |
| 4,139,107 | A * | 2/1979 | Ninomiya et al. | 414/392 |
| 4,319,864 | A | 3/1982 | Kaufeldt | |
| 4,396,218 | A | 8/1983 | Stevens | |
| 4,541,771 | A | 9/1985 | Beni et al. | |
| 4,890,750 | A | 1/1990 | Stern | |
| 5,184,860 | A | 2/1993 | Bouillon et al. | |
| 5,507,596 | A * | 4/1996 | Bostelman et al. | 405/191 |
| 5,729,453 | A * | 3/1998 | Lee et al. | 701/50 |
| 6,081,292 | A | 6/2000 | Lanigan, Jr. et al. | |
| 6,138,846 | A | 10/2000 | Baumann | |
| 6,161,887 | A * | 12/2000 | Shiota et al. | 294/81.2 |
| 6,206,127 | B1 | 3/2001 | Zakula, Sr. et al. | |
| 6,439,407 | B1 * | 8/2002 | Jacoff et al. | 212/274 |
| 6,644,486 | B2 * | 11/2003 | Jacoff et al. | 212/274 |

* cited by examiner

*Primary Examiner*—Thomas J. Brahan
(74) *Attorney, Agent, or Firm*—Gardner Carton & Douglas LLP

(57) ABSTRACT

A system and process are provided for controlling motion of a grappler of a gantry crane to avoid damaging an object to be lifted. In an embodiment, a speed of grappler movement is automatically reduced when in close proximity to the object. Furthermore, the grappler automatically stops when positioned appropriately to permit a latching mechanism to engage the object for lifting. Normal speed grappler motion is restored when the latching mechanism is fully engaged. In a particular embodiment, the grappler includes a plurality of height sensors at various positions along the grappler to determine the respective height of the grappler above a top of the object. Vertical motion of front and rear ends of the grappler are independently actuated and controlled to permit appropriate control when the grappler and/or the object are not level.

14 Claims, 12 Drawing Sheets

20
FRONT END HOIST ACTUATOR
702F
FRONT HEIGHT SENSOR
710
TWIST LOCK SENSOR
710
TWIST LOCK SENSOR
708
SHOE SENSOR
708
SHOE SENSOR
702C
CENTER HEIGHT SENSOR
706F
FRONT PLUNGER
714
INDICATOR DISPLAY
718
PUMP
716
CRANE HOIST CONTROL UNIT
704
CONTROLLER
712
INPUT DEVICE
706R
REAR PLUNGER
20
REAR END HOIST ACTUATOR
702R
REAR HEIGHT SENSOR
710
TWIST LOCK SENSOR
710
TWIST LOCK SENSOR
708
SHOE SENSOR
708
SHOE SENSOR

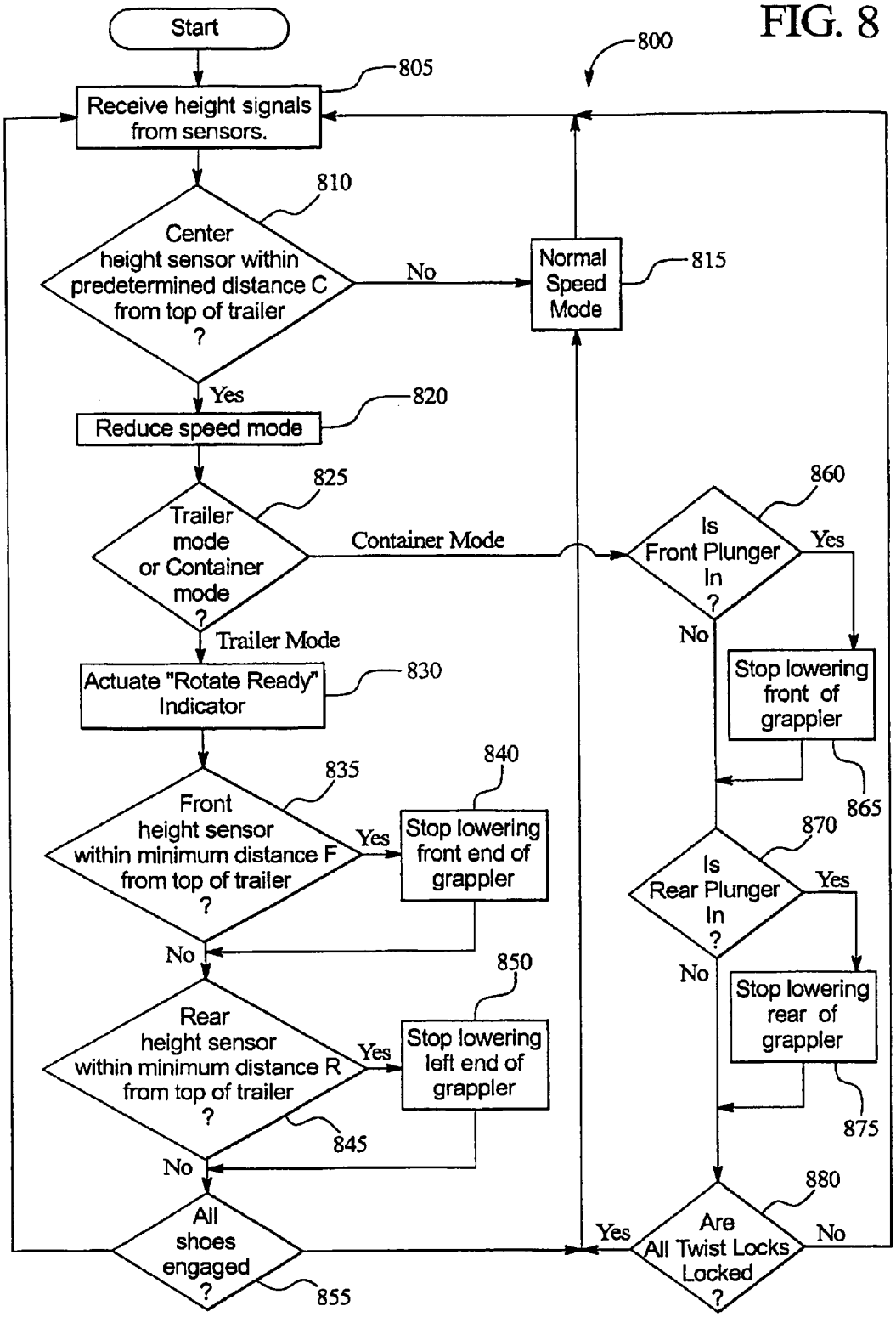
FIG. 8
Start
800
805
Receive height signals from sensors.
810
Center height sensor within predetermined distance C from top of trailer ?
No
Normal Speed Mode
815
Yes
820
Reduce speed mode
825
Trailer mode or Container mode ?
Container Mode
Trailer Mode
860
Is Front Plunger In ?
Yes
No
Stop lowering front of grappler
865
830
Actuate "Rotate Ready" Indicator
835
Front height sensor within minimum distance F from top of trailer ?
Yes
840
Stop lowering front end of grappler
870
Is Rear Plunger In ?
Yes
No
Stop lowering rear of grappler
875
No
850
Rear height sensor within minimum distance R from top of trailer ?
Yes
Stop lowering left end of grappler
845
No
All shoes engaged ?
855
880
Are All Twist Locks Locked ?
Yes
No

GRAPPLER CONTROL SYSTEM FOR A GANTRY CRANE

FIELD OF THE INVENTION

This invention generally relates to gantry cranes, and more particularly to a control system and associated method for moving and operating the grappler of a gantry crane in a manner to avoid damaging objects to be lifted.

BACKGROUND OF THE INVENTION

Gantry cranes are commonly used in ports, rail yards or other intermodal shipping facilities for lifting and moving objects such as containers and truck trailers. Such cranes are equipped with various grappler mechanisms to accommodate certain container configurations and associated standard latching systems. For example, highway trailers are typically lifted with a grappler having a swing-arm mechanism, and a standard shipping container typically has four twistlock latches located at the upper four corners of the container for lifting with a grappler having a plurality of corresponding twistlocks. Some grapplers are equipped with both swing arms and twistlocks for selective use as appropriate.

To lift a trailer, shipping container or the like, the crane operator typically maneuvers the crane into a position wherein the crane straddles the object to be lifted. The operator then adjusts the position of the grappler so as to bring the grappler into engagement with the object. To this end, the crane is configured so that the grappler can move in both a side-to-side or transverse direction and a vertical direction.

Unfortunately, due to operator misjudgment of the position of the grappler or other errors, the trailers and containers are occasionally damaged when the operator tries to engage the trailer or container with the grappler prior to lifting. For example, the roof of the object to be lifted can be damaged if the operator does not properly position the grappler or moves the grappler at too high a speed when it is lowered into engagement with the object. In addition, there is a risk that the object could be dropped and damaged if the operator does not properly engage the grappler with the object.

SUMMARY OF THE INVENTION

To reduce damage and to improve precision of grappler positioning, the present invention provides a process and system for controlling motion of a grappler of a gantry crane. Signals from the sensors are processed by a control unit which controls grappler motion.

The system includes a plurality of height sensors operable to detect a clearance distance below the grappler platform to the top of a trailer or shipping container to be lifted. Additionally, the system includes contact sensors to detect when the respective front and rear ends of the grappler have landed on a container.

In an embodiment, the process for controlling the grappler includes the steps of: providing a center height sensor mounted to the grappler at a generally central position, a front height sensor mounted to the grappler at a generally forward position, and a rear height sensor mounted to the grappler at a generally rearward position; determining if the center height sensor is less than a predetermined distance above a top of the object; reducing a speed of the grappler if the center height sensor is less than the predetermined distance (e.g., about two feet) from the top of the object; determining if the front height sensor has reached a minimum clearance relative to a top of the object so that the grappler is capable of engaging the front of the object; ceasing lowering the front end of the grappler if the front height sensor has reached the minimum clearance; determining if the height rear height sensor has reached a minimum clearance above the top of the object; ceasing lowering the rear end of the grappler if the rear height sensor has reached the minimum distance; detecting whether all of a plurality of latching mechanisms are fully latched; and permitting the grappler to move at a normal speed.

In an embodiment wherein the grappler is operated in a "trailer mode" to lift a trailer with grappler arms, the minimum clearance of each of the front and rear ends of the grappler is about one foot, as detected by the front and/or rear height sensor. The minimum end clearance can by any appropriate distance sufficient that the shoes of the grappler arms at that end of the grappler are low enough to reach under the trailer.

Damage is advantageously avoided during various maneuvers as a result of stopping the vertical movement of the front and rear ends of the grappler before touching the trailer top. For example, when the crane operator is positioning the grappler to pick up a trailer, the control process prevents the grappler platform from landing on the top of the trailer, which is unnecessary. Also, when the grappler has lifted trailer and the operator is lowering the grappler to place the trailer down (e.g., on the ground or on a railroad flatbed), the operator typically maneuvers the grappler to first touch down an end of the trailer which has a "fifth-wheel" style tractor hitch, the opposite end of the trailer with wheels being tilted upwardly. In such a condition, the control system prevents the grappler from landing on the top of the trailer after the first end has been placed on the ground. The operator does not need to be concerned about working respective front and rear grappler elevation controls in order to avoid contacting the tilted grappler into the trailer as the trailer is set down.

In an embodiment wherein the grappler is operated in "container mode" to lift a standard shipping container, each of the front and rear height sensors is a contact sensor, such as a plunger switch. The minimum clearance is reached when the respective plunger is pressed in due to contact with the top of the object, and accordingly, the minimum clearance is effectively zero distance.

In an embodiment, the latching mechanisms include a plurality of pivotable grappler arms that extend downwardly from the grappler along at least two sides of the object, and each of the arms has a grappler shoe that is positionable against a bottom edge of the object, the detecting step includes detecting whether all of the grappler shoes are positioned against a bottom edge of the object.

In an embodiment wherein each of the grappler shoes is equipped with a contact sensor, the detecting step includes determining whether all of the contact sensors are contacting against the trailer to be lifted.

In an embodiment wherein the object to be lifted is a standard shipping container and wherein the latching mechanisms include a plurality of twistlocks positioned to engage corresponding locking latches located in a the top of the container, the detecting step includes determining whether all of the twistlocks are respectively locked in the corresponding locking latches.

In embodiment, the process further includes the step of actuating an indicator to prompt the operator to pivot the grappler arms downwardly when the grappler is low enough so that the grappler shoes can reach under the trailer.

An advantage of the present invention is that it provides an improved system and method for controlling motion of a grappler.

Another advantage of the present invention is that it provides a system and method for controlling motion of a grappler that reduces potential damage to an object to be lifted by the grappler.

A further advantage of the present invention is that it provides a system and method for controlling motion of a grappler that increases operator reaction time and thereby increases operating precision.

Yet another advantage of the present invention is that it provides a system and method for controlling motion of a grappler that permits operation at a reduced speed when the grappler is within a predetermined proximity of the object to be lifted.

These and other features and advantages are described in, and will be apparent from, the following description, figures and claims.

BRIEF DESCRIPTION OF THE DRAWINGS

FIG. 8 is a flow chart of an exemplary embodiment of the grappler control process according to teachings of the present invention.

FIGS. 9*a–d* are schematic side views of a grappler used in "trailer mode," wherein: FIG. 9*a* illustrates the grappler being lowered toward the trailer, the grappler arms in a raised, retracted position; FIG. 9*b* illustrates the grappler at position wherein the center height sensor has reached a predetermined distance C above the top of the trailer to a "rotate ready" position where the grappler arms are rotated downward and the grappler being lowered at a reduced speed; FIG. 9*c* illustrates the grappler at a position wherein one of the front height sensor has reached a minimum distance F above a top of the trailer, stopping further lowering of the front end of the grappler; and FIG. 9*d* illustrates the grappler in a fully lowered position wherein both of the front and rear height sensors has reached the minimum distance above the trailer, F and R, respectively, ready for the arms to clamp inwardly to lift the trailer.

FIGS. 10*a–b* are schematic side views of a grappler that is operating in "trailer mode" for mounting the trailer to a rail car having a "fifth wheel" hitch, wherein: FIG. 10*a* shows the grappler holding the trailer in a tilted-forward orientation, moving rearwardly to latch the "fifth wheel" hitch to a corresponding mount on a rail car; and FIG. 10*b* shows the grappler holding the trailer in the tilted-forward orientation, the trailer being engaged to the fifth-wheel hitch, ready for the rear of the trailer to be lowered to rest on the rail car.

FIGS. 11*a–c* illustrate the grappler operating in "container mode" to pick up a standard shipping container, wherein: FIG. 11*a* illustrates the grappler being lowered toward the top of the container to a position wherein the center height sensor has reached a predetermined height C to proceed at a reduced speed; FIG. 11*b* illustrates the grappler at a position wherein the rear plunger has engaged a top of the container; and FIG. 11*c* illustrates the grappler at a fully lowered position wherein both of the plungers have engaged the top of the container.

DETAILED DESCRIPTION OF THE PRESENTLY PREFERRED EMBODIMENTS

Figure 1:
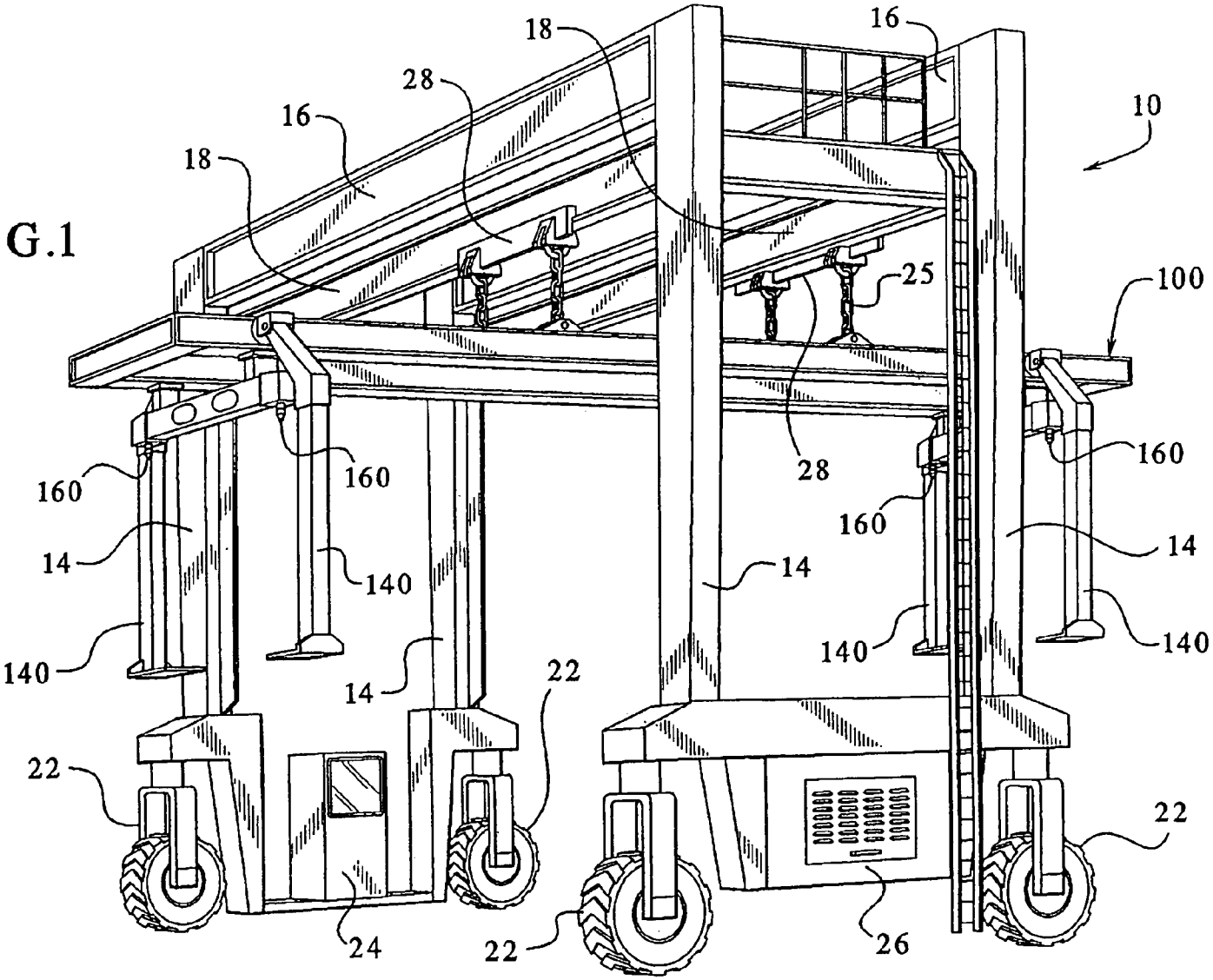
FIG. 1 is a perspective view of a gantry crane which can be equipped for operation in accordance with teachings of the present invention.
Figure 2:
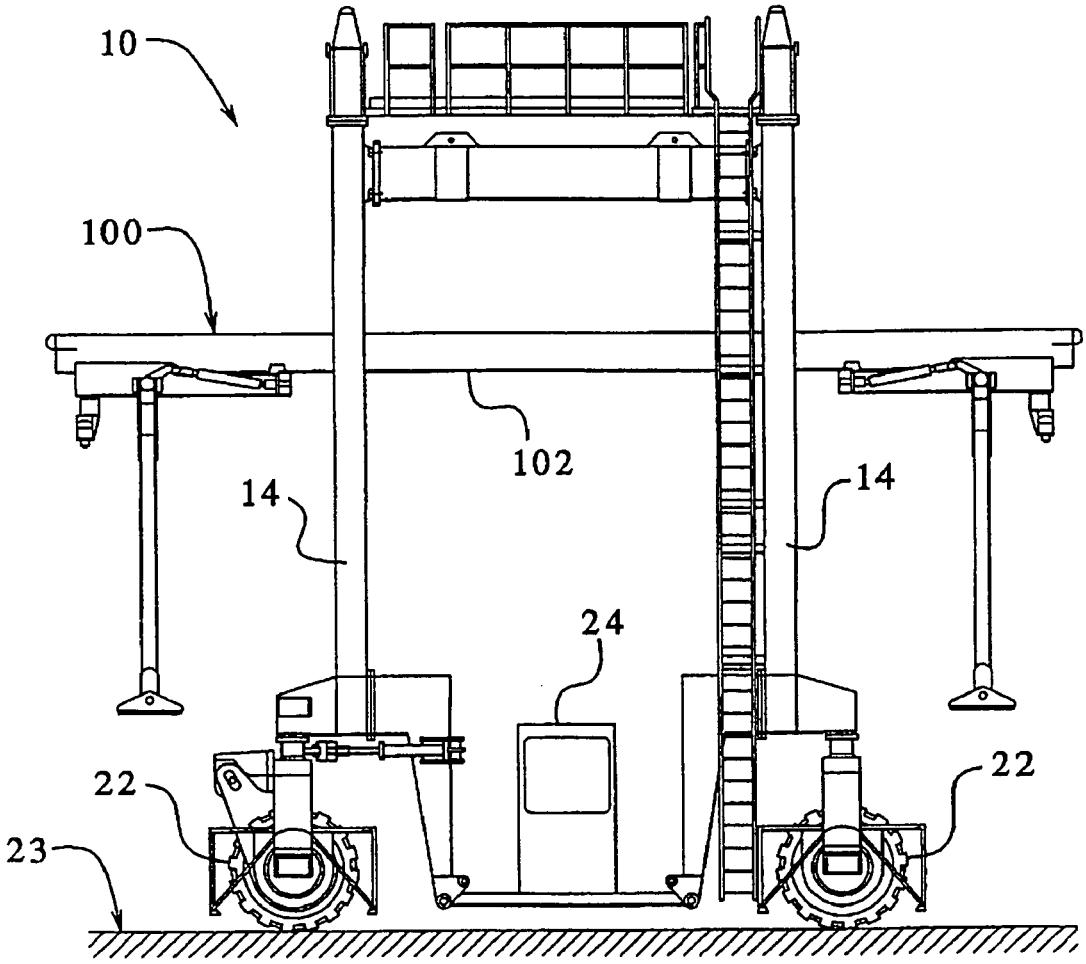
FIG. 2 is a side elevation of the gantry crane of FIG. 1.
Figure 3:
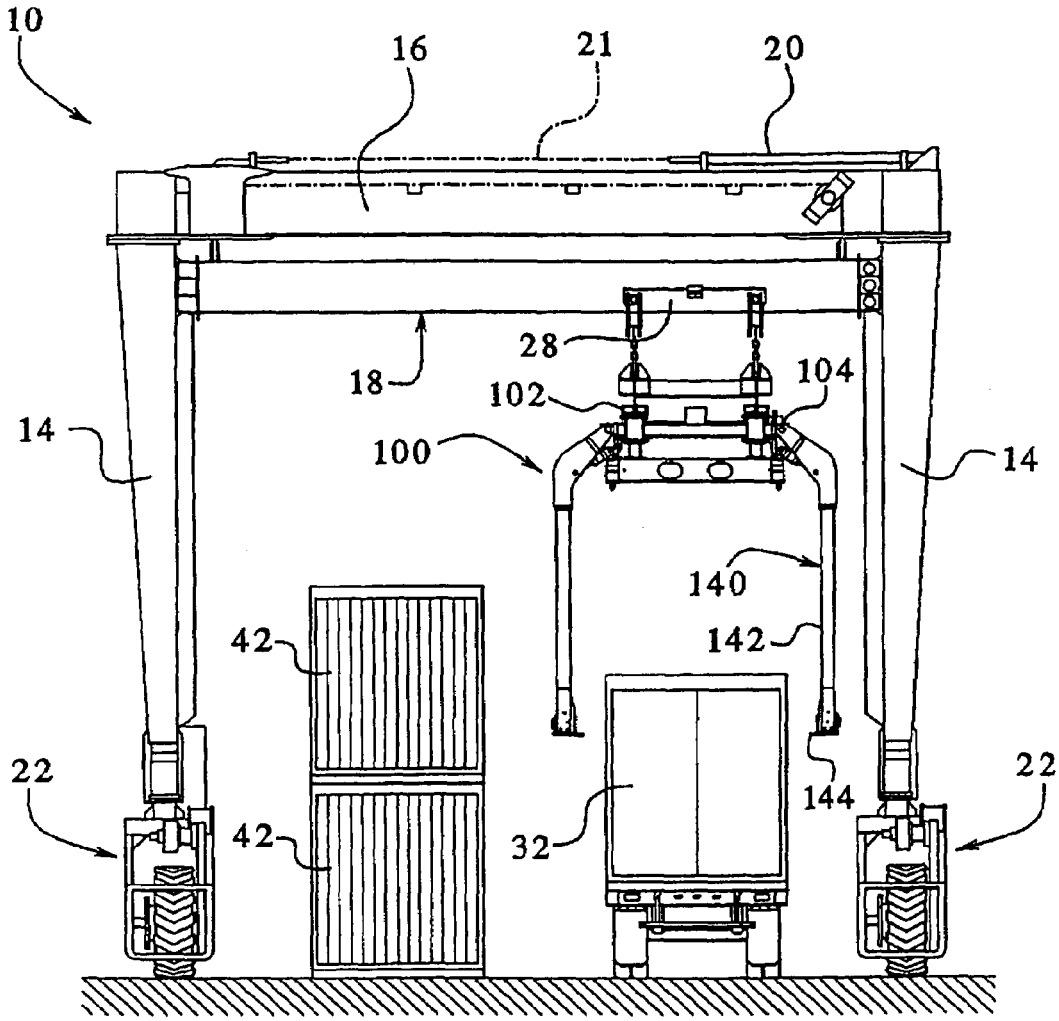
FIG. 3 is a rear elevation of the gantry crane of FIG. 1 near objects that may be lifted, including a stack of containers and a trailer.

Now turning to the drawings, FIGS. 1, 2 and 3 illustrate an exemplary gantry crane 10. The illustrated gantry crane 10 includes a frame structure having four generally vertical columns 14, and front and rear support beams 16 rigidly mounted to extend generally horizontally between respective pairs of the columns. For engaging an object to be lifted, the crane includes a grappler 100, which will be described in greater detail below.

Although stationary cranes are known, cranes are commonly provided as mobile units adapted for maneuvering on a pavement. For example, as illustrated in FIG. 1, the crane 10 is equipped with a plurality of wheel assemblies 22 having rubber tires to support the columns 14. The wheel assemblies 22 are actuatable to drive, steer and maneuver the crane 10 on a pavement surface in a desired manner. Such a mobile crane is generally referred to in the industry as a rubber-tired gantry, or RTG.

Referring to FIGS. 1 and 2, the crane 10 includes a cab 24 mounted to the frame for accommodating an operator. The cab 24 contains controls for steering, driving, and maneuvering the crane 10 and for manipulating the motion and functions of the grappler. The crane 10 also includes a power unit 26, typically having an internal combustion engine driving a hydraulic pump to move the various components of the crane 10 through a hydraulic system.

In the example illustrated in FIGS. 1–3, the grappler 100 generally includes an elongate frame or platform 102 which is equipped with two types of latching mechanisms. Firstly, the for lifting certain types of objects having a bottom edge suitable for lifting contact, the grappler includes a plurality of grappler arms 140. As is known in the art, grappler arms 140 are commonly used to lift trailers, such as trailer 32 illustrated in FIG. 3. Secondly, the grappler 100 includes a plurality of twistlocks 160 of the conventional type used for lifting a standard shipping container 42 (FIG. 3) having universally configured locking latches. However, as will be appreciated from the following description of the invention, the present invention is not limited to grapplers having both grappler arms 140 and twistlocks 160. Rather, the present invention is equally applicable to all types of grapplers capable of engaging or grasping a load including grapplers having only twistlocks, only swing arms, or other appropriate latching mechanisms. Moreover, those skilled in the art will recognize that the grappler 100 can be configured and used for lifting a variety of types of objects. Accordingly, the terms "trailer" and "container" as used herein shall not be construed to limit the scope of the invention and shall include any object or load capable of being lifted by the grappler.

In the case wherein the grappler 100 is equipped with arms 140, as illustrated in FIGS. 1–3, the crane 10 generally may be constructed as described in connection with U.S. patent application Ser. No. 10/093,183 filed Mar. 6, 2002, and Ser. No. 10/092,833 filed Mar. 7, 2002, each of which is incorporated herein by reference.

For vertically lifting the grappler, the crane 10 further includes a hoisting mechanism, such as front and rear vertically moveable stabilizer beams 18. Each of the stabilizer beams 18 is movably mounted to extend generally horizontally between a respective pair of the columns. Various mechanisms may be used to actuate the vertical lifting of the stabilizer beams 18. For example, the crane 10 includes front and rear hydraulic hoist actuators 20 mounted to the respective support beams 16. The hoist actuator 20 will be described in connection with FIG. 3, which shows a rear of the crane 10, and it will be understood that the hoist actuator 20 at the front of the crane 10 is operable in a like manner. Each of the hoist actuators 20 is connected to a cable or chain 21 that suspends the respective stabilizer beam 18. By actuating the hydraulic actuator, the cable or chain 21 can be extended or retracted to raise or lower the respective stabilizer beam 18. The illustrated hoist actuator 20 is a hydraulic piston-cylinder assembly, but it will be recognized that other types of actuators may be used.

In order to move the grappler 100 in a transverse direction, the crane 10 includes front and rear trolleys 28 as illustrated in FIGS. 1–3. Each of the trolleys is mounted to glide along the respective front and rear stabilizer beams 18. For example, each of the trolleys includes a plurality of rollers that glide along a surface of the respective stabilizer beam. Additionally, each of the trolleys is driven by an appropriate means, for example, by cables actuated by a hydraulic piston or hydraulic motor. The platform 102 is suspended from the trolleys 28 by chains 25 or some other appropriate structure.

It will be recognized that the crane 10 of FIGS. 1–3 has an exemplary configuration, and that other appropriate hoisting mechanisms could be implemented. For example, one known lifting means includes a hoist system having movable wire ropes from which the grappler is suspended from overhead trolleys mounted to fixed upper support beams. In another system, the movable stabilizer beams are suspended from wire ropes that are fed and retracted from a rotatable drum. The present invention may be implemented with cranes having these and other structures, as appropriate.

Referring to FIG. 3, each of the arms 140 is shaped to reach under an object. For example, each of the arms 140 includes an elongate body 142 and a contact shoe 144 mounted at a lower end of the body. The arms 140 are shaped to extend downwardly alongside an object to be lifted so that the shoes 144 are positionable at an underside of the object. In particular, the contact shoe 144 extends generally inwardly to reach under the frame of the trailer 32 for lifting. Additionally, each of the arms 140 is pivotably mounted to the platform 102 at a respective dual-axis pivot joint 104.

Figure 4:
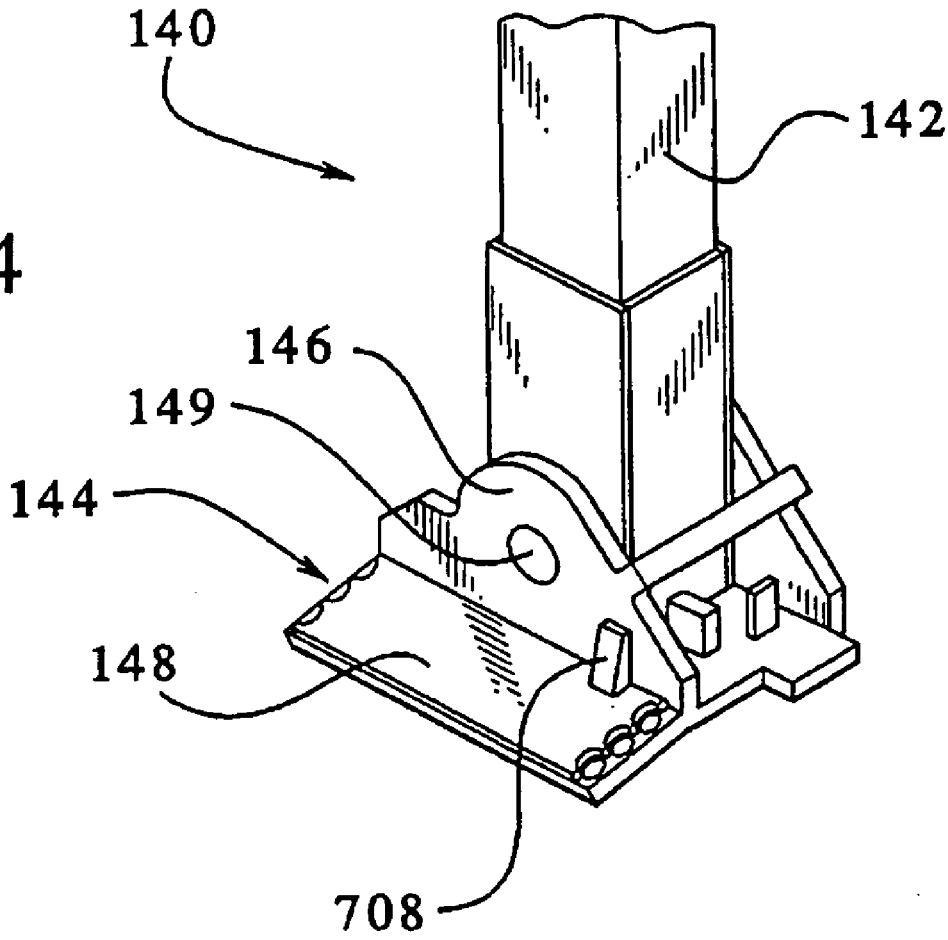
FIG. 4 is a fragmentary perspective view of a lower portion of one of the arms, showing the grappler shoe.

The shoe 144 is illustrated in greater detail in FIG. 4. The shoe 144 generally includes a mounting portion 146 which is mounted to the lower end of the elongate body 142 of the arm 140 and a cantilevered lifting shelf 148 that extends from the mounting portion 146. As illustrated in FIG. 4, the mounting portion 146 of the contact shoe 144 a pin 149 extends through the mounting portion 146 and a lower end of the elongate body 142 to pivotably hold the shoe 144.

Figure 5A:
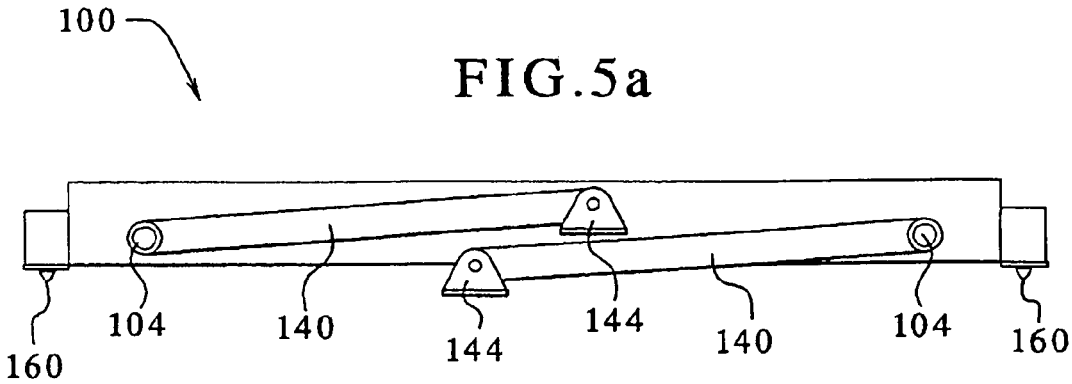
FIGS. 5*a* and 5*b* are schematic side views of the grappler, FIG. 5*a* illustrating the grappler arms pivoted upwardly to a retracted position for use of the twistlocks to lift a shipping container, and FIG. 5*b* illustrating the grappler arms pivoted downwardly to a "ready" position for engaging an underside of an object to be lifted.
Figure 5B:
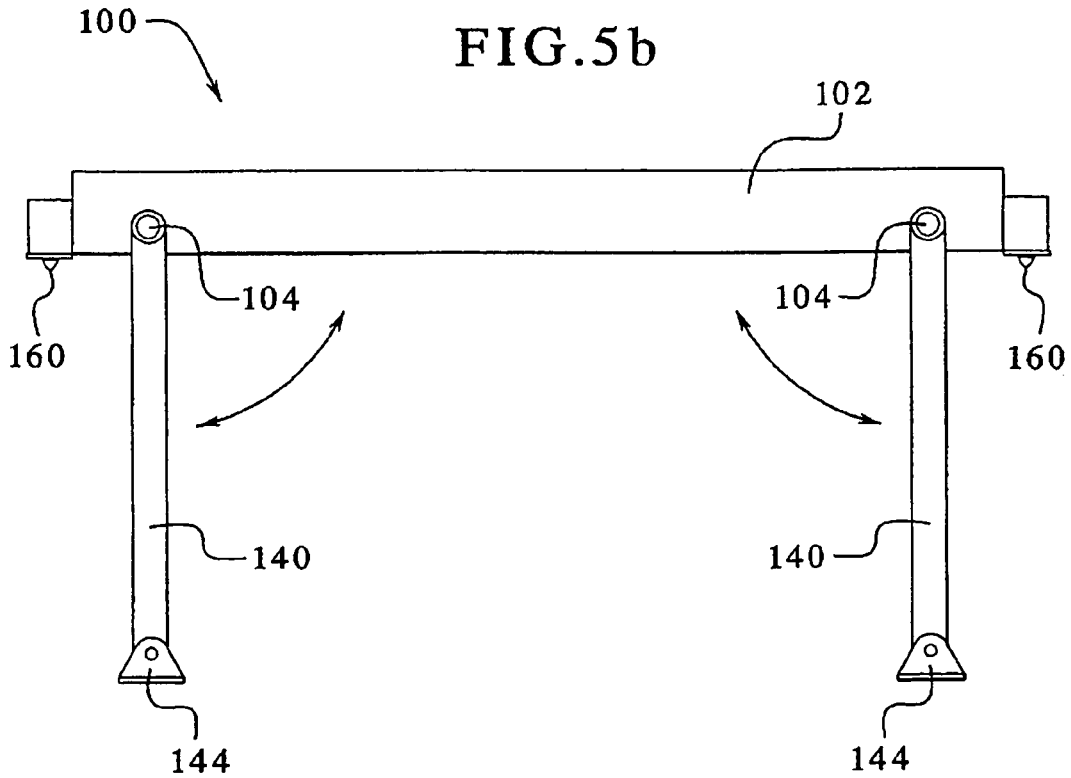
Figure 6A:
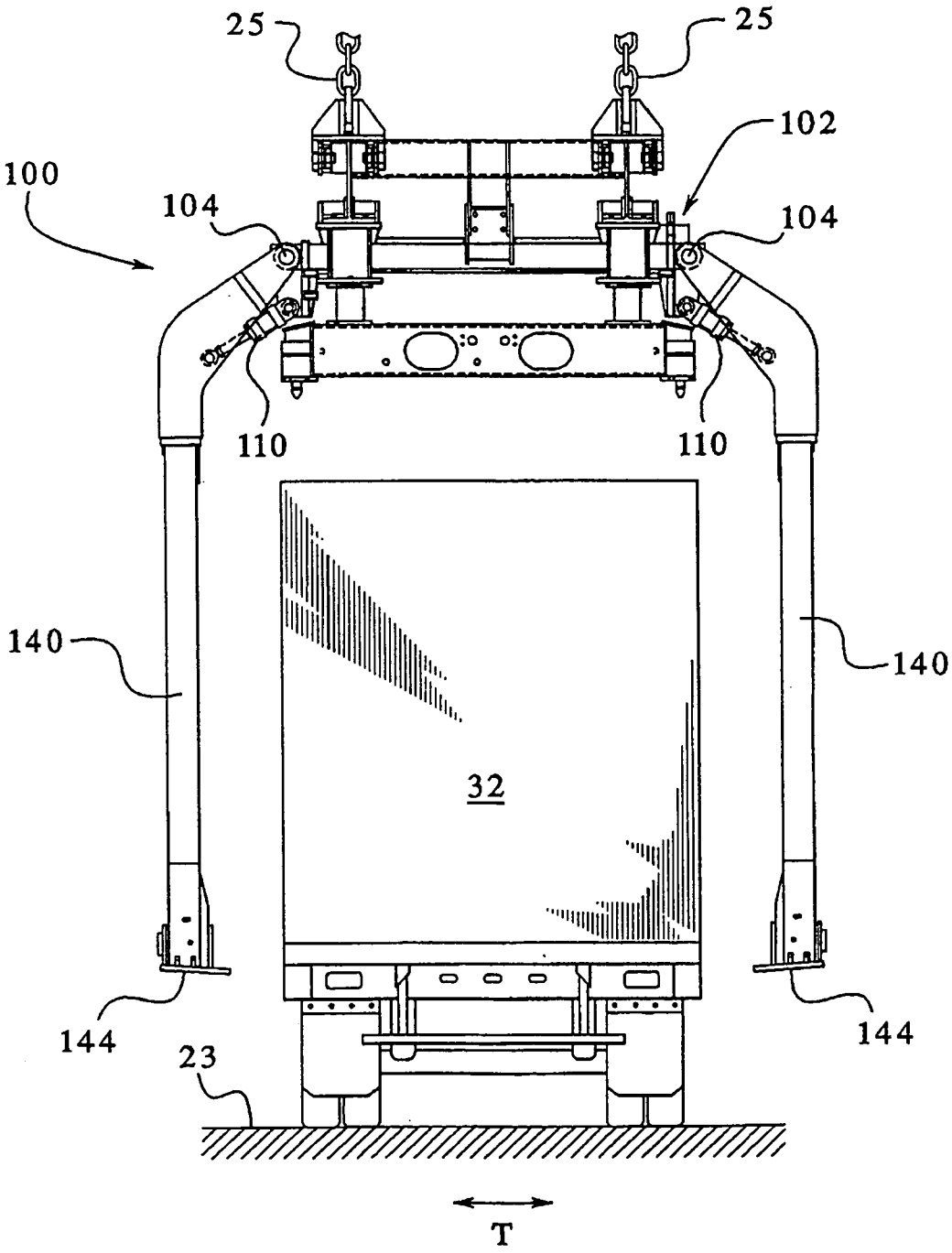
FIGS. 6*a* and 6*b* are rear elevational views of the grappler and a trailer to be lifted, FIG. 6*a* illustrating the grappler arms in an open position, FIG. 6*b* illustrating the grappler arms in a closed position and lifting the trailer.
Figure 6B:
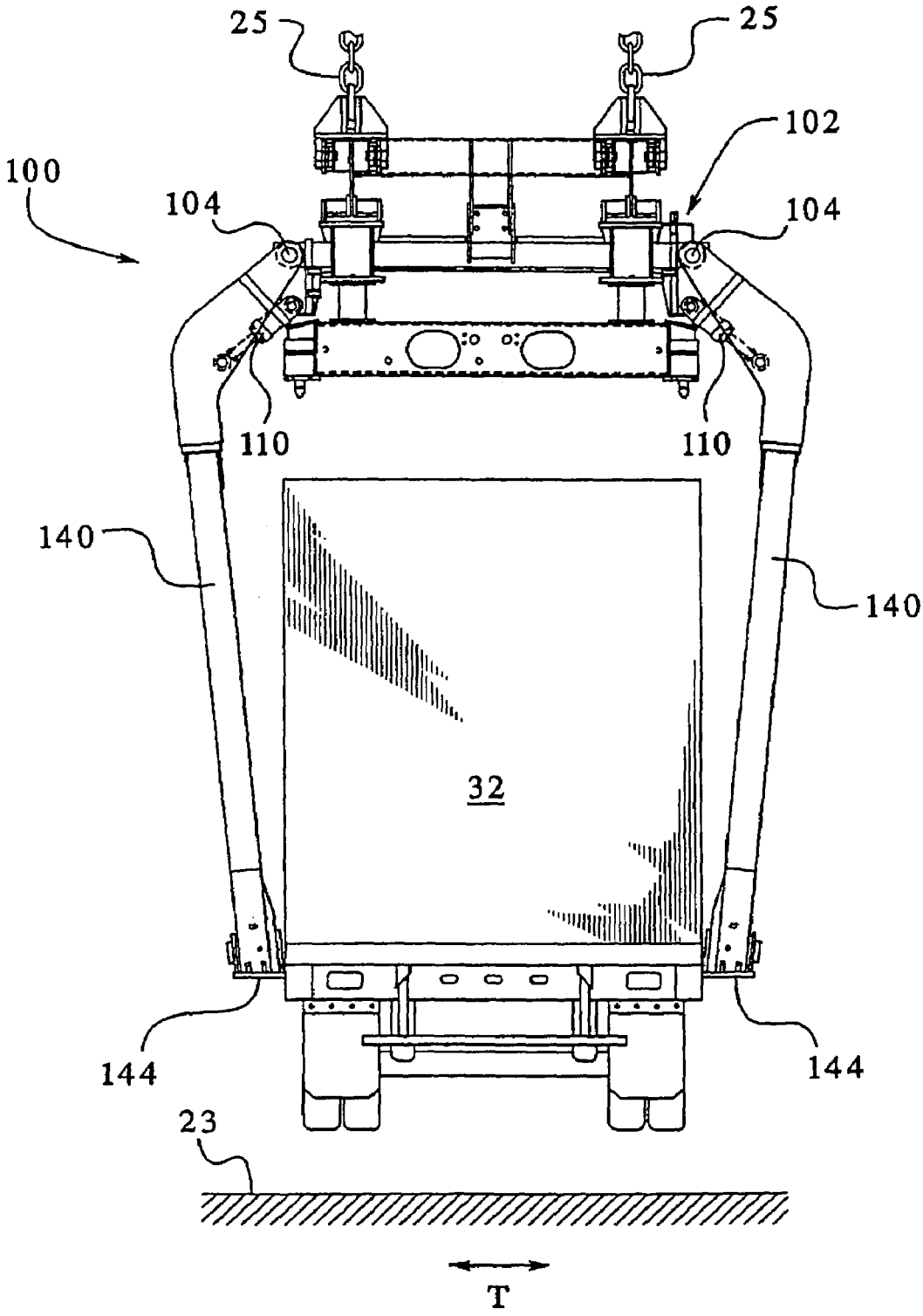

Each of the pivot joints 104 permits two ranges of grappler arm motion. Firstly, the joints 104 facilitate movement of the arms 140 between retracted and extended positions, as illustrated in FIGS. 5*a* and 5*b*, respectively. In the retracted position, each of the arms 140 is arranged adjacent the platform 102 in a generally horizontal orientation as shown in FIG. 5*a* to allow clearance for the grappler 100 to move freely over objects. In the extended position, the arms 140 extend downwardly from the platform 102 in a generally vertical direction as shown in FIG. 5*b*. Secondly, when the grappler arms 140 are in the extended position, each of the arms 140 is movable at the pivot joint 104 between an open position, as illustrated in FIG. 6*a*, and a closed or clamped position, as illustrated in FIG. 6*b*. When the arms 140 are in the open position, (FIG. 6*a*) the grappler 100 is free from the trailer 32 so that the grappler can be lowered and positioned prior to clamping the trailer. When the arms 140 are in the closed position (FIG. 6*b*), the grappler shoes 144 are positioned inwardly under the trailer. The shoes 144 contact upwardly against the bottom edge of the frame and lift the trailer 32 as the grappler 100 is then raised by the front and rear stabilizer beams 18 (FIGS. 1–3).

To move the arms 140, the crane 10 includes a plurality of arm actuators 110. In the example shown in FIGS. 6*a* and 6*b*, each of the actuators 110 is a piston-cylinder assembly that can be extended to move the respective arm 140 outwardly and retracted to move the arm 140 inwardly. Hydraulic actuators are also linked to move the arms between the retracted and extended positions of FIGS. 5*a* and 5*b* respectively.

For lockably engaging standard shipping containers 42, the grappler 100 additionally includes twistlocks 160. A standard shipping container 42 conventionally has latches located in its upper corners, and the twistlocks 160 may be of a known type that can lockably engage the locking latches for lifting. More particularly, in this case, the grappler 100 includes four male twistlocks 160 mounted in a rectangular pattern corresponding to the positions of universal locking latches provided at the top corners of the standard shipping container 42. Generally, the grappler 100 is lowered in proper alignment onto the top of the container 42, and the twistlocks 160 are matably received into the locking latches. The twistlocks 160 are then actuated to rotate within the locking latches, securing the container 42 to the grappler 100 in a generally known manner. When the twistlocks 160 are engaged, the grappler 100 can lift the shipping container 42.

In operation, the operator must properly manipulate the crane elements in order to carefully lower the grappler in position to engage the object to be lifted. For example, when employing the twistlocks 160 to engage a container 42, the grappler 100 must be carefully landed on an upper surface of the container 42 in corresponding alignment with the locking latches of the container. Also, when employing the grappler arms 140, the operator must maneuver and lower the grappler 100 into the proper position, rotate the grappler arms 140 to the extended position, (FIGS. 5*b* and 6*a*) pivot the grappler arms inwardly to the closed position, and raise the grappler to engage the shoes against the underside to the trailer to be lifted (FIG. 6*b*). As will be appreciated, it can be difficult for an operator to accurately judge the position of the grappler relative to the trailer or container when performing these maneuvers. Containers 42 and trailers 32 are sometimes damaged by conventional manually guided grapplers. Common damage to the trailers and containers includes failure to properly position the grappler relative to the trailer or container, lowering the grappler at too high of a speed such that it collides with the top of the container or trailer, and dropping of the container or trailer.

Grappler Control Process and System

In accordance with an aspect of the present invention, the gantry crane is equipped with a system to move the grappler according to a control process adapted to avoid causing damage to the container, trailers or other objects to be lifted. In particular, the grappler control system can be adapted to limit or reduce the speed of movement of the grappler when the grappler is in relatively close proximity to a container or trailer so as to provide an operator with greater control over the movement of the grappler. As will be appreciated, the slower motion speeds will make it easier for the operator to maneuver the grappler into the proper position for engagement with the trailer or container. Moreover, the grappler control system can be adapted to prevent, or limit the impact of, undesired contact between the grappler platform and the trailer or container. The grappler control system can also be adapted to ensure that the container or trailer is properly secured by the grappler prior to allowing the grappler to lift the object.

Figure 7:
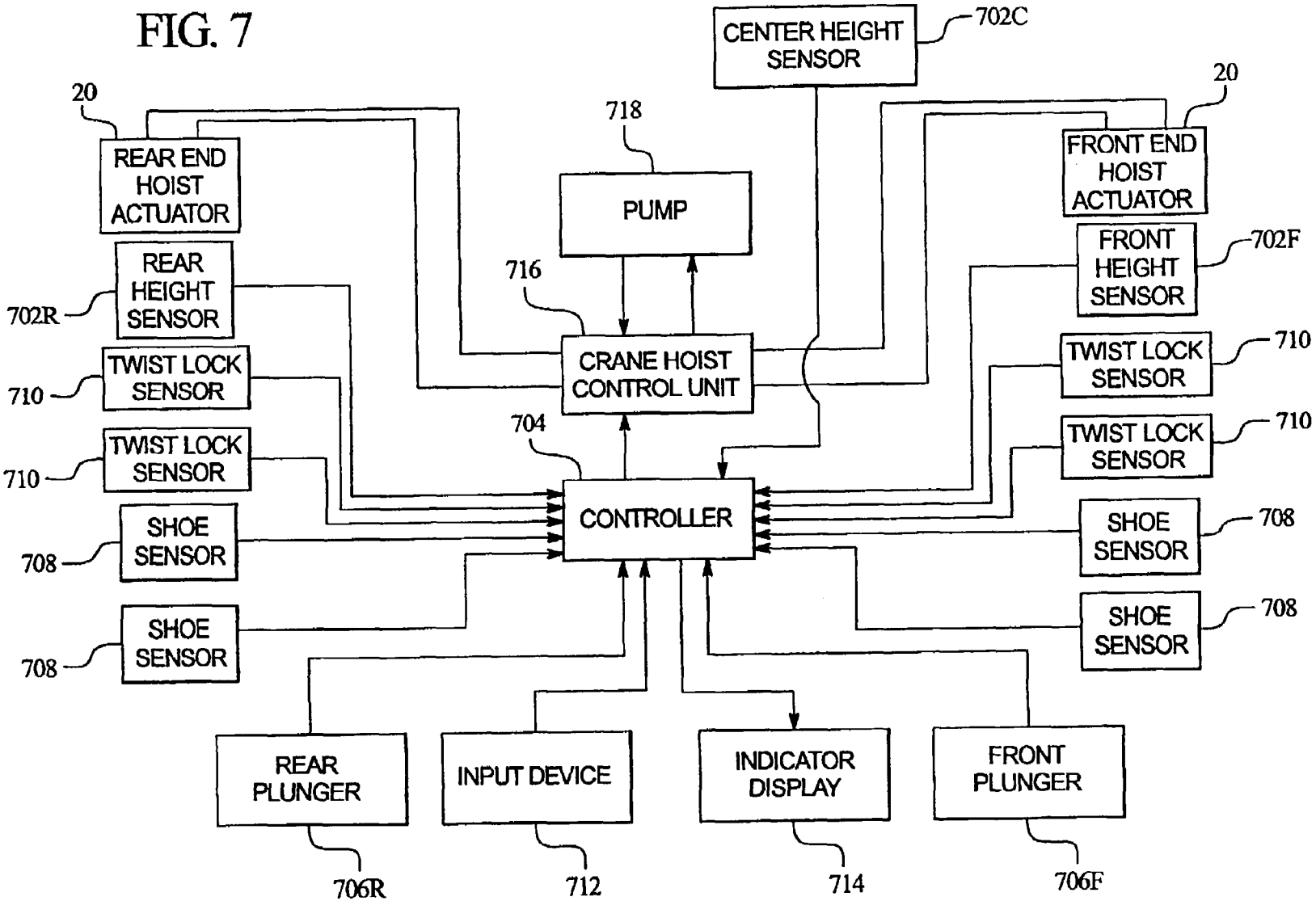
FIG. 7 is a schematic diagram of a grappler control system constructed according to teachings of the present invention.

To this end, for determining the distance between the grappler platform and the top of the object to be lifted, the grappler includes a plurality of sensors to determine the distance or position of the grappler relative to an object below. More particularly, the crane 10 is equipped with an exemplary grappler control system 700, as illustrated in FIG. 7 which includes height sensors 702F, 702C, 702R that are mounted to the grappler platform 102 generally at corresponding front, center and rear positions, respectively. The system 700 also includes a controller 704 having a processor that executes software instructions for controlling the motion of the grappler according to a grappler control process 800, described below in greater detail with reference to FIG. 8. Still referring to FIG. 7, each of the height sensors 702F, 702C, 702R sends a respective signal to the controller that represents the distance downwardly from the corresponding position on the grappler platform to the top of the trailer. As will be known to those skilled in the art, the height sensors 702F, 702C, 702R may any suitable type of distance sensor, for example ultrasonic sensors, infrared sensors, laser sensors, radio frequency sensors, etc.

For detecting when the grappler has landed on a top of a container, the grappler control system 700 of FIG. 7 also includes front and rear plungers 706F and 706R, respectively. The front and rear plungers 706F, 706R are mounted to twistlock portions of the platform generally at corresponding front and rear ends of the grappler to detect when the respective front and rear ends have landed on a top of the container. Each of the plungers 706F, 706R sends an corresponding signal to the controller 704 to indicate that the plunger has been pressed in due to contact. The plungers 706F, 706R are effectively front and rear height sensors that detect when the distance to the top of the object has reached a minimum distance of zero.

To determine when the grappler has securely engaged an object for lifting, the grappler control system 700 further includes a plurality latch sensors, for example a plurality of shoe sensors 708 and a plurality of twistlock sensors 710. Each of the shoe sensors 708 is mounted to one of the grappler shoes 144, as illustrated in FIG. 4. Each of the shoe sensors 708 is operable to send an associated signal to the controller to indicate that the respective grappler shoe is properly engaged against a lower lifting surface of a trailer or other object. The shoe sensor 708 may be, for example, a contact sensor or switch that closes due to contact against a lower corner of the trailer. Additionally, the system further includes a plurality of twistlock sensors 710. Each of the twistlock sensors 710 is associated with one of the twistlocks 160 (e.g., FIGS. 1–3) and is capable of detecting and sending a signal to indicate whether the respective twistlock is properly engaged into the corresponding locking latch of a shipping container.

An operator can select a desired direction of grappler motion with an input device 712 which sends an input signal to the controller 704. For example, the input device may be joystick or grappler up/down lever in the cab. Additionally, the controller 704 may be operable to actuate an indicator display 714 configured to alert the operator of one or more conditions.

In response to the signals from the various sensors and user input, the controller 704 manages a crane hoist control unit 716 that directs hydraulic fluid pressurized by a hydraulic pump 718 to front and rear hoist actuators 20, which independently cause vertical movement of the respective front and rear ends of the grappler.

Figure 10A:
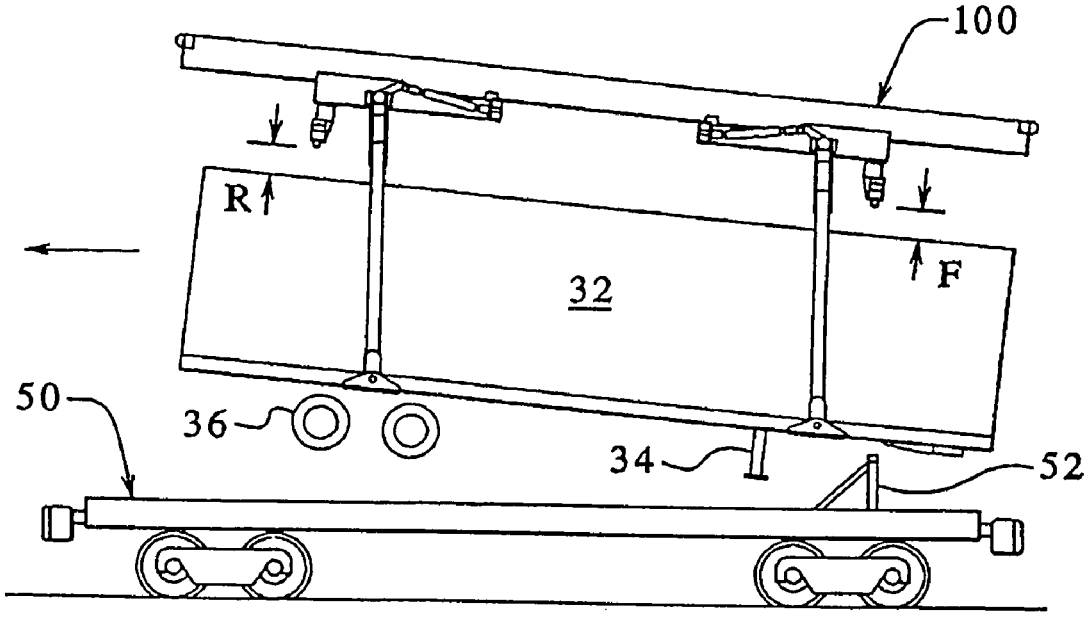
Figure 11A:
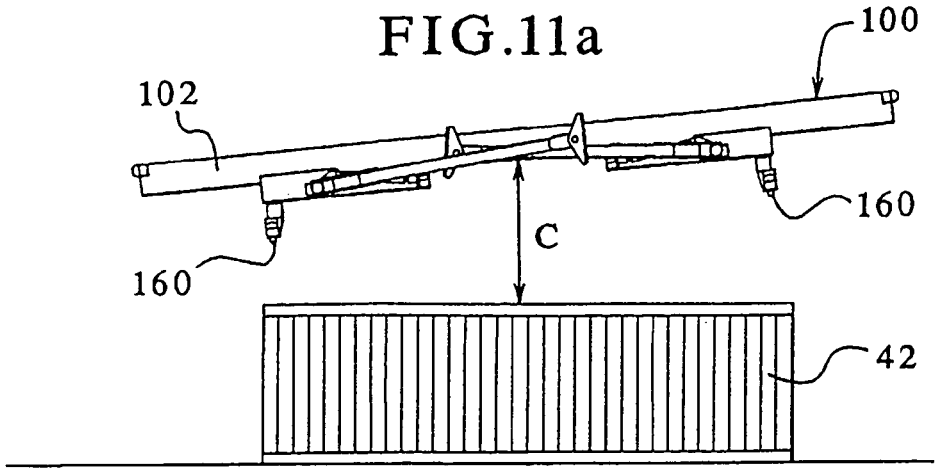
Figure 11B:
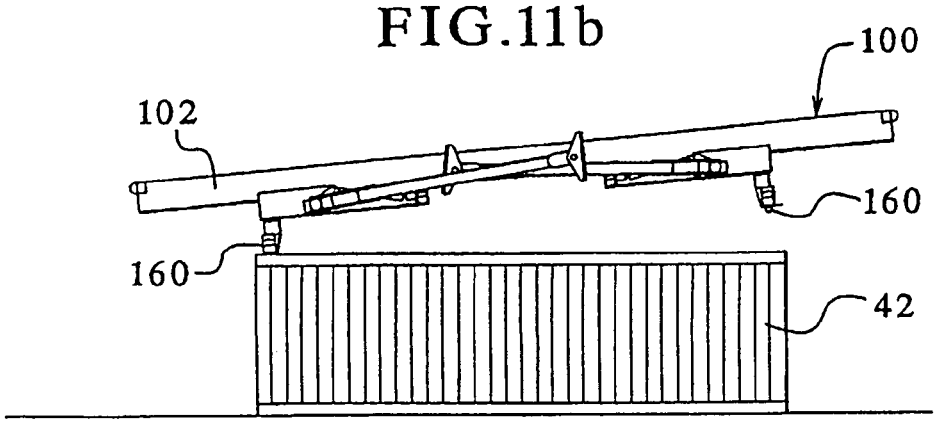
Figure 11C:
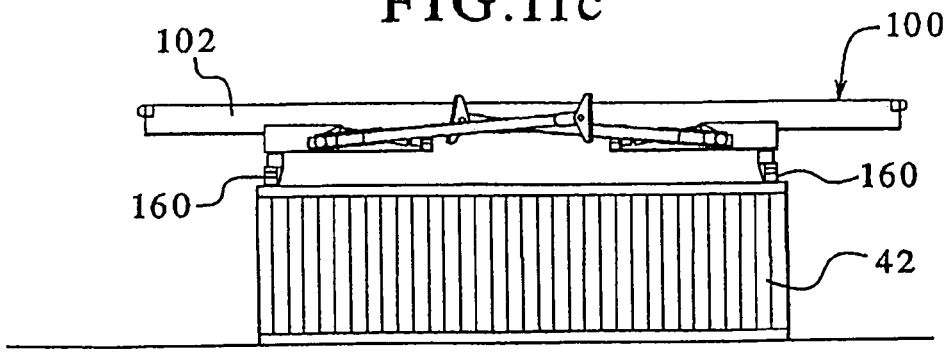

In accordance with an embodiment of the invention, FIG. 8 sets forth an exemplary process 800 for controlling a grappler of a gantry crane. The process is particularly useful for controlling motion of the grappler so as to avoid damaging the object to be lifted as the grappler is maneuvered and lowered into position to engage the object for lifting. The process 800 of FIG. 8 will be described in connection with the system 700 (FIG. 7), as well as with reference to illustrations the grappler operating in "trailer mode" (FIGS. 9*a–d* and 10*a,b*) and "container mode" (FIGS. 11*a–c*). Those of ordinary skill in the art will recognize that the process 800 may be stored as executable software instructions in a memory and/or storage device that is part of the controller 704 (FIG. 7).

Initially, signals from the height sensors are received by the system controller at step 805 of the process 800 in FIG. 8. More particularly, with reference to the system 700 of FIG. 7, the height sensors 702F, 702C, 702R send signals to the control unit 704. The signals represent the downward distance between the grappler and the top of the object to be lifted, such as a trailer or shipping container. Preferably, the signals are periodically sent so that the controller can monitor the relative grappler position in a constant manner as the grappler is moved.

In order to provide greater operating precision, to permit better operator reaction, and to prevent damage to the object from lowering the grappler too quickly, the system is adapted to reduce the speed of grappler motion when the center height sensor is within a predetermined proximity of the top surface of the trailer or container to be lifted. More particularly, step 810 of the process 800 determines whether the center sensor is within a predetermined distance C from the top of the object. If not, the motion of the grappler proceeds in a normal speed mode as indicated at step 815. The normal speed mode is set to permit reasonably quick and efficient movement, which is desired when the grappler is not very close to the object. However, if step 810 determines that the center sensor is within the predetermined distance, grappler movement proceeds in a reduced speed mode indicated at step 820. The reduced speed mode permits movement of the grappler at a slower maximum rate than in the normal speed mode. To limit the speed of grappler movement in the reduced speed mode, with reference to the system 700 of FIG. 7, the controller 704 operates the crane hoist control unit 716 to limit the actuation speed of the front and rear hoist actuators 20.

The rate of grappler movement in the reduced speed mode is set to permit more precise handling of the grappler by the operator and to reduce the inertia of the grappler in the event of direct contact with the object. For example, in the reduced speed mode of step 820, the grappler can move at a maximum rate that is one-half the maximum rate possible during the normal speed mode of step 815, however the speed rates permitted in the reduced speed mode and normal speed mode can be set as appropriate. The predetermined distance of step 810 can be set at any suitable distance. The decreased speed within the predetermined distance C advantageously reduces a possibility of damaging the object by inadvertent or sudden grappler movement.

As described above, the grappler is preferably equipped for lifting either trailers or containers. Herein, operation of the grappler to lift a trailer (or other object) using the grappler arms will be referred to as "trailer mode" and operation of the grappler to lift a container (or other object) using the twistlocks will be referred to as "container mode." As indicated at step 825, the process 800 of FIG. 8 provides control in either trailer mode or container mode. In an embodiment, the operator may select the mode with a switch, in which case the controller 704 (FIG. 7) operates accordingly.

In an embodiment wherein an input signal instructs the controller whether the operator has selected "trailer mode" or "container mode", the predetermined distance C can be set at a respective value for each mode. For example, the predetermined distance C may be set a about two feet for operation in trailer mode, and the predetermined distance C can be set at about one foot for operation in the container mode. Of course, the predetermined distance C could alternatively be set at the same value for each mode.

The process 800 will now be described connection with steps 810–855 as the grappler operates in trailer mode. The grappler arms may be in the retracted position (FIG. 5*a*) as the grappler is initially lowered toward the trailer. Accordingly, when the center height sensor is within the predetermined distance C, as determined at step 810, step 830 actuates a "rotate ready" indicator in the cab, alerting the operator that the grappler arms may be rotatably moved to the extended position (FIG. 5*b*) in preparation for engaging and lifting the trailer. With reference to the system 700 of FIG. 7, the "rotate ready" indicator 714 may be a light, a display, a speaker that generates an audible tone, or any desired type of indicator. It is noted step 830 could be configured to actuate the "rotate ready" indicator at any appropriate height of the grappler above the top of the trailer, including some preset height other than the predetermined distance C of step 810.

To prevent unnecessary contact between the grappler and the trailer, the clearance under the grappler is monitored and the respective front and rear ends of the grappler automatically cease moving once the grappler comes within a minimum distance from the top of the trailer. More particularly, still referring to the process 800 of FIG. 8, when either the front height sensor or rear height sensor comes within the minimal distance F (front sensor) or R (rear sensor), as determined at steps 835 and 845, respectively, the lowering movement of the corresponding end of the grappler is stopped at steps 840 and 850, respectively. At steps 840 and 850, referring to FIG. 7, the controller 704 causes the crane hoist control unit to stop actuating the appropriate front and/or rear hoist actuators 20. This eliminates the possibility that the grappler platform will be inadvertently lowered to collide with the top of the trailer. Additionally, the front and rear minimum distances F, R are selected so that the shoes are at a vertical level suitable to appropriately move under the trailer for lifting when the arms are moved to the clamped position. In an embodiment, for example, each of the minimum front and rear distances F, R, is set at 12 inches.

The control process 800 of FIG. 8 restores normal speed motion of the grappler when the selected latching mechanisms (e.g., grappler arms or twistlocks) are fully latched, i.e., after all of the selected latching mechanisms have engaged the object to be lifted. This ensures that the object is securely held by the grappler and reduces a risk that the grappler would drop the object. For example, when operated in trailer mode, step 855 permits normal speed motion of the grappler when all of the contact shoes are engaged against the trailer. The indicator display 714 (FIG. 7) may be adapted to indicate that all shoes and/or twistlocks are properly latched.

Referring now to steps 810–880, the process 800 will be described as the grappler is operated in container mode. When the grappler has been moved to within the predetermined distance C so that it is limited to a reduced speed (steps 810 and 820) the process 800 allows continued movement of the grappler at the reduced speed until the grappler contacts the top of the container. Specifically, when the front plunger is pressed in due to contact against the top of the container, as determined at step 860, the front of the grappler ceases to be lowered, as indicated at step 865. Likewise, when the rear plunger has been pressed in due to contact against the top of the container, as determined at step 870, the rear of the grappler ceases to be lowered, as indicated at step 875, thereby safely landing the front of the grappler on the top of the container.

Referring to the system 700 of FIG. 7, the controller 704 is operable to vary the hydraulic flow through the crane hoist control unit 716 to allow the front and rear hoist actuators 20 to operate within a normal speed range, at a reduced speed range, or to respectively cease moving according to the process of FIG. 8. The controller 704 has a processor that runs software accessed from a memory and/or storage device to execute instructions for controlling the respective front and rear hoist actuators 20 according to the process of FIG. 8.

When operated in the "container mode," step 880 of the control process 800 restores full speed motion (step 815) of the grappler only if all of the latching mechanism is fully latched, i.e., if all of the twistlocks are engaged or disengaged. If some but not all of the respective contact shoes or twistlocks are engaged, then the controller does not permit lifting of the container. To allow for normal control of the grappler once the grappler has been disengaged from an object such as after it has been lifted and moved, the controller can be adapted to resume normal speed motion of the grappler (step 815) once the center height sensor indicates that the grappler has moved beyond the predetermined distance from the container.

Also, the control process resumes normal speed grappler motion when center height sensor has been moved beyond the predetermined distance, whereby the grappler is safely free from the object.

Figure 9A:
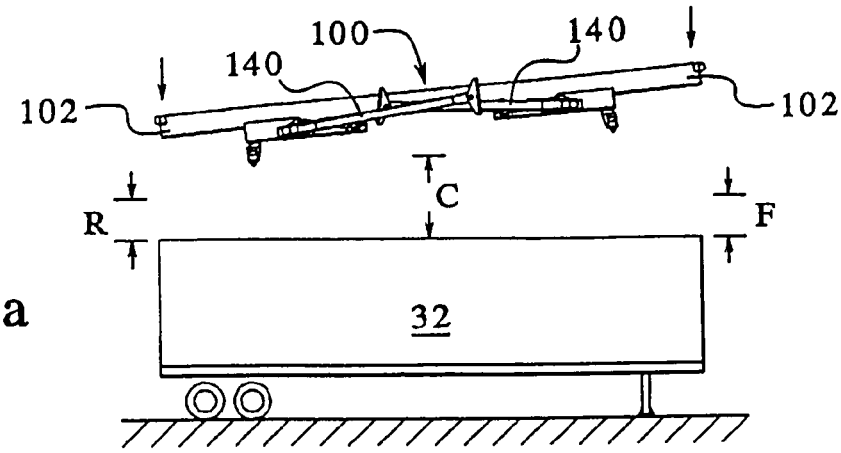
Figure 9B:
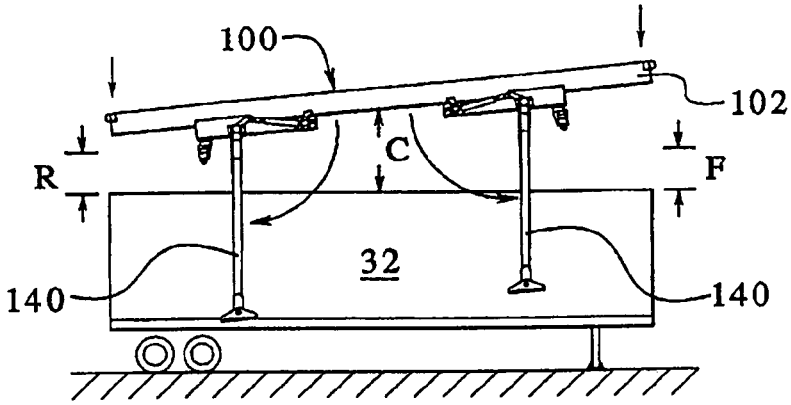
Figure 9C:
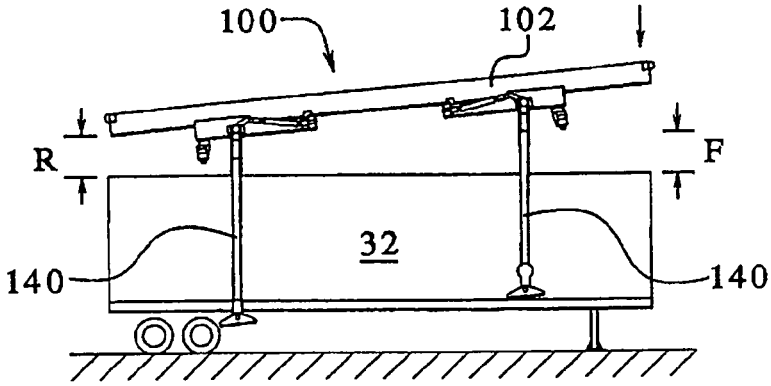
Figure 9D:
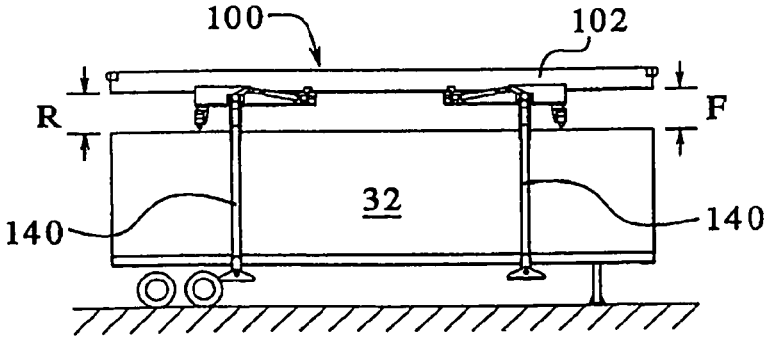

The grappler control process will be described with reference to FIGS. 9*a–d*, which illustrate various stages of grappler motion while operating in trailer mode. As illustrated in FIG. 9*a*, the grappler 100 is initially positioned generally above the trailer 32 with the grappler arms 140 in a retracted position. A center of the grappler platform 102 is higher than the predetermined distance C, and therefore, the grappler can operate at normal speeds in the condition illustrated in FIG. 9*a*. When the grappler is lowered so that the center of the grappler platform 102 reaches the predetermined distance C, as illustrated in FIG. 9*b*, grappler motion is then limited to the reduced rate of speed. Also, at this point, the "rotate ready" light can be indicated in the cab, prompting the arms 140 to be rotated to the extended position. Turning to FIG. 9*c*, both the front and rear ends of the grappler have continued to be lowered until the rear end of the grappler 100 has reached the minimum rear clearance R. The system ceases lowering the rear end of the grappler 100 at this point, but the front end of the grappler can still be lowered, because in the condition illustrated in FIG. 9*c*, the front end of the grappler platform 102 is still higher than the minimum front clearance F. Accordingly, the front end continues to be lowered until the grappler platform reaches the position illustrated in FIG. 9*d*, wherein both the front and rear ends of the grappler platform have reached their respective minimum clearances R, F. The grappler platform 102 is generally parallel to the top of the trailer 32. The grappler arms 140 can be pivoted inwardly to engage the trailer for lifting. Of course, it will be recognized that conditions may arise where the front end of the grappler arrives at the minimum front clearance F before the rear end reaches the clearance R, in which case the front end ceases to be lowered while the rear end continues to drop until the grappler platform 102 is even with a top of the trailer 32.

Figure 10B:
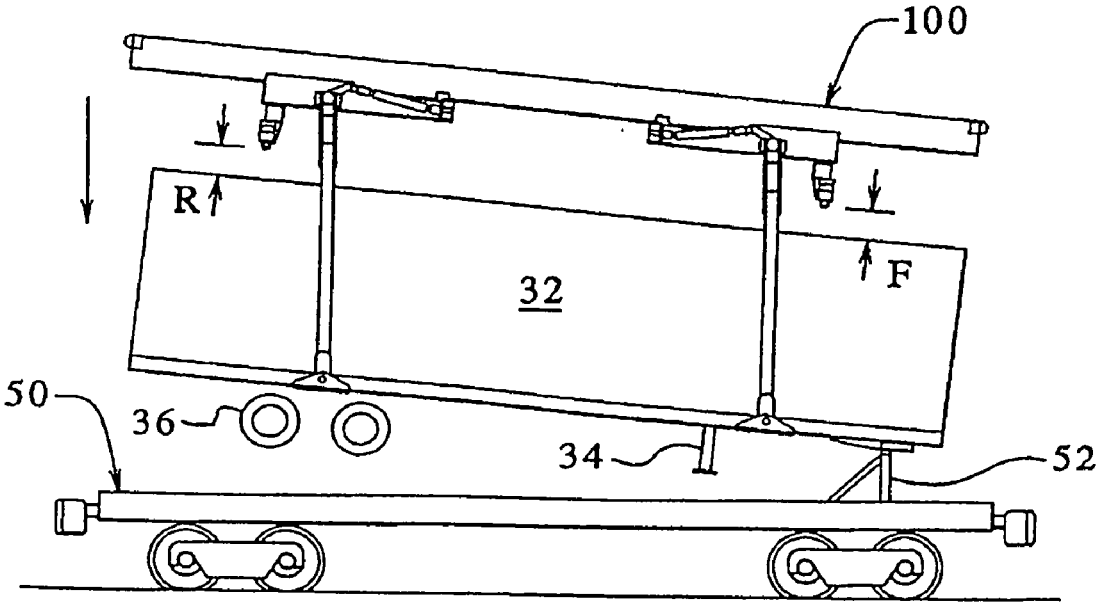

Independent controllability of the ends of the grappler also substantially eases operations which require the grappler to operate with one end higher than the other. For example, referring to FIGS. 10*a* and 10*b*, when the grappler 100 has lifted the trailer 32 and the operator is lowering the grappler to place the trailer onto a flatbed railcar 50, the operator typically maneuvers the grappler to first touch down the front end of the trailer which has a "fifth-wheel" style tractor hitch to engage a corresponding mount 52 on the railcar 50. During this operation, the opposite end of the trailer with the wheels tilted upwardly, as illustrated in FIG. 10*a*. In such a condition, the control system 700 and method 800 prevent the grappler from landing on top of the trailer after the front end has been placed on the ground or on the flatbed railcar 50 and while the rear end continues to be lowered. The operator does not need to be concerned with working the respective front and rear grappler elevation controls in order to avoid contacting the tilted grappler into the trailer as the trailer is set down. Specifically, FIG. 10*a* illustrates a condition wherein the grappler is holding the trailer 32 tilted with the front end lower than the rear end. The front end is at a vertical position so that the grappler 100 and trailer 32 can be moved in a rearward direction to engage the fifth-wheel hitch to the mount 52 of the railcar 50. FIG. 10*b* illustrates a condition wherein the grappler 100 has moved the trailer 32 rearwardly to engage the fifth-wheel hitch to the mount 52, at which point the grappler 100 can be lowered so that the rear wheels 36 and front legs 34 of the trailer are set down on the flatbed railcar 50. Because the grappler control system 800 (FIG. 8) prevents the front and rear ends of the grappler from moving closer than the minimum clearances F, R respectively, the operator can simply lower the grappler which automatically remains at a clearance distance from the trailer, avoiding a need for the operator to manually adjust the front or rear ends of the grappler to avoid contact. The grappler is self-adjusting in such a situation.

The grappler control process will now be described in connection with FIGS. 11*a–c*, in which the grappler is illustrated operating in container mode. The grappler may not always be maintained parallel to the containers that it picks up. For example, a container can be placed on an uneven surface or the grappler may be adjusted to an uneven position as the operator maneuvers to lift the container, as illustrated in FIG. 11*a*. The control process of the present invention is useful for controlling the actuators which are lowering respective front and rear ends of the grappler in order to land the grappler 100 on top of the container 42 without damage and with minimal operator effort. FIG. 11*a* illustrates a condition wherein the center of the grappler platform 100 has reached the predetermined distance C, so that the grappler is moved at a reduced speed as it approaches the container 42. As the grappler 100 moves at a reduced rate, the operator can adjust the grappler motion to align the twistlocks 160 with locking latches at corners of the container 42. FIG. 11*b* illustrates a condition wherein the rear twistlocks have landed before the front twist locks 160, due to the tilted angle of the grappler 100. At this point, a plunger or contact sensor has been actuated to stop further lowering of the rear end of the grappler as the front end continues to be lowered until, as illustrated in FIG. 11*c*, both ends of the grappler have safely landed on top of the container 42 with the twistlocks 160 properly aligned. The twistlocks 160 can all be latched to permit the grappler to lift the container 42 at a normal speed.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A process for controlling motion of a grappler of a gantry crane to lift an object, the grappler including plurality of latching mechanisms to engage the object, the process comprising:

providing a center height sensor mounted to the grappler at a generally central position, a front height sensor mounted to the grappler at a generally frontward position, and a rear height sensor mounted to the grappler at a generally rearward position;

determining if the center height sensor is less than a predetermined distance above a top of the object;

automatically reducing a maximum speed of the grappler if the center height sensor is less than a predetermined distance from the top of the object;

determining if the front height sensor has reached a minimum distance from a top of the object, less than said predetermined distance, such that the grappler is capable of engaging the front of the object;

automatically cease lowering the front end of the grappler if the front sensor has reached the minimum distance;

determining if the rear height sensor has reached the minimum distance from a top of the object;

automatically cease lowering the rear end of the grappler if the rear sensor has reached the minimum distance;

detecting whether the latching mechanism is fully latched; and permitting the grappler to move at a normal speed if all of the latching mechanisms are fully latched.

2. The process of claim 1, wherein the front height sensor reaches the minimal distance when the front height sensor is less than a predetermined distance away from the top of the object.

3. The process of claim 1, wherein the rear height sensor reaches the minimal distance when the rear height sensor is less than a predetermined distance away from the top of the object.

4. The process of claim 1, wherein the front sensor is a plunger, and wherein the front height sensor reaches the minimal distance when the plunger contacts against the top of the object.

5. The process of claim 1, wherein the rear sensor is a plunger, and wherein the rear sensor reaches the minimal distance when the plunger contacts against the top of the object.

6. The process of claim 1, wherein the latching mechanism includes a plurality of pivotable grappler arms that extend downwardly from the grappler along at least two sides of the object, each of the arms having a grappler shoe positionable against a bottom edge of the object, wherein the detecting step includes detecting whether all of the grappler shoes are positioned against a bottom edge of the object.

7. The process of claim 6, wherein each of the grappler shoes is equipped with a contact sensor, the detecting step includes determining whether all of the contact sensors are contacting against object to be lifted.

8. The process of claim 6, further comprising the step of actuating an indicator to prompt the arms to be pivoted downwardly if the center height sensor is less than a predetermined distance from the top of a trailer.

9. The process of claim 1, wherein the object is a standard shipping container and wherein the latching mechanism includes a plurality of twistlocks positioned to respectively engage corresponding locking latches located generally at of the top surface of the container, wherein the detecting step includes determining whether all of the twistlocks are respectively locked position in the corresponding locking latches.

10. A system for controlling a grappler of a gantry crane for engaging and lifting objects wherein the grappler has a front end, a rear end, and a plurality of latching members mounted to the platform for engaging the object, the system comprising:

a front actuator operable to cause vertical motion of a front end of the grappler;

a rear actuator operable to cause vertical motion of a rear end of the grappler;

a front height sensor mounted to grappler generally at the front end, the front height sensor operable to detect a downward distance to a top of the object below;

a rear height sensor mounted to grappler generally at the rear end, the rear height sensor operable to detect a downward distance to a top of the object below; and a center height sensor mounted to grappler between the front sensor and the rear sensor, the center height sensor operable to detect a downward distance to a top of the object below;

wherein a controller is operable to receive signals from the height sensors, to automatically limit the front and rear actuators to a speed that is reduced relative to a normal speed when the center sensor detects a downward distance less than a predetermined distance, to cease downward actuation of the front actuator when the front height sensor detects a downward distance less than a minimum distance, the minimum distance being less than the predetermined distance, and to automatically cease downward actuation of the rear actuator when the rear height sensor detects a downward distance less than the minimum distance.

11. The system of claim 10, further comprising at least one latch sensor operable to detect when the grappler has made a lifting engagement with the object, wherein the controller is operable to restore normal speed grappler motion when all of the latch sensors respectively detect a lifting engagement.

12. The system of claim 11, wherein the grappler includes a plurality of pivotable arms, each of the arms including a shoe that is positionable under the object to be lifted, wherein the latch sensor is a contact sensor operable to detect when the shoe is engaged against a lower edge of the object.

13. The system of claim 12, wherein the grappler includes a plurality of twistlocks adapted to engage a standard shipping container, each of the latch sensors detecting when an associated one of the twistlocks is in a lifting engagement with the shipping container.

14. The system of claim 10, wherein the grappler includes a plurality of twistlocks adapted to engage a standard shipping container, wherein each of the height sensors is a plunger operable to detect contact against the top of the object and wherein the minimum distance is about zero.

* * * * *